US008672134B2

(12) United States Patent
Sprada et al.

(10) Patent No.: US 8,672,134 B2
(45) Date of Patent: Mar. 18, 2014

(54) CHILD-RESISTANT MEDICATION CONTAINER

(75) Inventors: Peter John Sprada, London (GB); Robert Prasser, Guttaring (AT)

(73) Assignee: Merck Serono SA, Coinsins (CH)

( * ) Notice: Subject to any disclaimer, the term of this patent is extended or adjusted under 35 U.S.C. 154(b) by 476 days.

(21) Appl. No.: 12/936,568

(22) PCT Filed: Mar. 31, 2009

(86) PCT No.: PCT/IB2009/005131

§ 371 (c)(1),
(2), (4) Date: Dec. 3, 2010

(87) PCT Pub. No.: WO2009/125267

PCT Pub. Date: Oct. 15, 2009

(65) Prior Publication Data

US 2011/0067363 A1 Mar. 24, 2011

(30) Foreign Application Priority Data

Apr. 9, 2008 (EP) ..... 08007030

(51) Int. Cl.
*B65D 83/04* (2006.01)
*B65D 85/42* (2006.01)

(52) U.S. Cl.
USPC ..... 206/531; 206/1.5; 220/23.91

(58) Field of Classification Search
USPC ..... 206/531, 1.5, 223, 539, 538; 53/492, 53/169; 220/23.91
See application file for complete search history.

(56) References Cited

U.S. PATENT DOCUMENTS

| | | | | |
|---|---|---|---|---|
| 6,460,693 | B1 | 10/2002 | Harrold | |
| 6,848,577 | B2 * | 2/2005 | Kawamura et al. | 206/449 |
| 7,549,541 | B2 * | 6/2009 | Brozell et al. | 206/531 |
| 2004/0045858 | A1 | 3/2004 | Harrold | |
| 2004/0256277 | A1 * | 12/2004 | Gedanke | 206/538 |
| 2007/0045150 | A1 * | 3/2007 | Huffer et al. | 206/538 |

(Continued)

FOREIGN PATENT DOCUMENTS

| | | | |
|---|---|---|---|
| CA | 2428862 | A1 | 11/2004 |
| WO | 2004037657 | A2 | 5/2004 |
| WO | 2005030606 | A1 | 4/2005 |
| WO | 2007030067 | A1 | 3/2007 |

OTHER PUBLICATIONS

International Search Report, dated May 28, 2009, from corresponding PCT application.

*Primary Examiner* — Mickey Yu
*Assistant Examiner* — Rafael Ortiz
(74) *Attorney, Agent, or Firm* — Young & Thompson

(57) ABSTRACT

The child-resistant medication container includes:

a housing having an open end, a support slidably mounted in the housing for supporting medication, first locking element for locking the support in the housing and for unlocking the support so that the support may be slid to the outside of the housing through the open end, the first locking element including a first locking member coupled to the housing and a second locking member coupled to the support, the first and second locking members being engageable with each other, and at least one button operable to act on the first locking element, the at least one button including a first button operable to disengage the first and second locking members, second locking element for maintaining engagement between the first and second locking members, and a second button operable to act on the second locking element to permit disengaging the first and second locking members by operating the first button.

43 Claims, 9 Drawing Sheets

(56) References Cited

U.S. PATENT DOCUMENTS

2007/0284277 A1 12/2007 Gnepper
2008/0023475 A1* 1/2008 Escobar et al. ..... 220/23.91
2009/0178948 A1* 7/2009 Reilley et al. ..... 206/531
2009/0184022 A1* 7/2009 Coe et al. ..... 206/531
2009/0255842 A1* 10/2009 Brozell et al. ..... 206/531

* cited by examiner

CHILD-RESISTANT MEDICATION CONTAINER

The present invention pertains to a container for the delivery of medication, more particularly to a child-resistant medication container.

Solid medications, in the form of tablets, pills, capsules or the like, are often stored in a blister card, which consists of a sheet, generally of plastic material, defining chambers (blisters) and on the back side of which a sealant film such as an aluminium or a paper foil is fixed. A medication dose contained in a blister may be released by pressing on the blister to collapse the latter and puncture the sealant foil.

To protect children and others from unsupervised access to medication, child-resistant medication containers have been proposed which comprise a housing containing medication and which require, for their being opened, a sequence of operations which a child normally cannot perform or would not think to perform.

In particular, the International patent applications WO 2004/037657 and WO 2005/030606 describe child-resistant medication containers comprising a housing and a blister card slidably mounted in the housing but locked therein. The blister card may be unlocked and slid out of the housing through an open end thereof by pressing one button provided at a top wall of the housing and by pulling the blister card while the button is pressed.

The American patent application US 2007/0284277 describes a child-resistant medication container comprising a housing and a tray slidably mounted in the housing but locked therein. The tray contains tablets. The tray may be unlocked and slid out of the housing through an open end thereof by simultaneously pressing and then sliding two lateral slide buttons.

The American patent application US 2004/0045858 describes a child-resistant medication container comprising a housing and a blister card slidably mounted in the housing but locked therein. The blister card may be unlocked and slid out of the housing through an open end thereof by simultaneously pressing two lateral push buttons and then actuating an optional lever to push the blister card or holding the housing downward to allow the blister card to drop out.

The containers described in the above-mentioned patent applications do not have a very high child resistance because only two successive actions are required to open the container.

The American patent application US 2004/0256277 describes a child-resistant medication container comprising a housing and a blister card slidably mounted in the housing but locked therein. The blister card may be unlocked and slid out of the housing through an open end thereof by pressing two lateral push buttons and then pulling the blister card while the lateral push buttons are pressed. To enable its being pulled, the blister card defines a tab which projects out of the housing through the open end and which may be seized by the user. This container does not have a very high child resistance because simultaneously pressing two lateral buttons is rather intuitive and only two successive actions are required to open it. Moreover, in this container, the blister card is permanently exposed, leaving the possibility for an unauthorised person to open the blisters with a tool such as a knife and access the medication.

The International patent application WO 2007/030067 describes a child-resistant medication container comprising a housing and a blister card. The housing is open in its top portion so as to permanently expose the blister card and has a bottom wall with holes. The blister card is slidably mounted in the housing between a locked position in which the blisters are offset relative to the holes and an unlocked position in which the blisters are aligned with the holes to enable the release of the medication through the holes. An operating member having two finger receiving regions locks the blister card when in a first position and unlocks the blister card when in a second position. The passage from the first position to the second position of the operating member is achieved by successively pushing the two finger receiving regions in two different directions. The operating member, irrespective of its position, retains the blister card in the housing. Since the blister card is permanently exposed, access to the medication using a tool is possible and the security of this container is therefore not very high.

The U.S. Pat. No. 6,460,693 describes a child-resistant medication container comprising a housing and a tray slidably mounted in the housing but locked therein. The tray contains a blister card. The tray may be unlocked by being pushed inward into the housing and then by pressing one button provided at the top wall of the housing. A drawback of this container is that it requires a bulky locking/unlocking mechanism at its rear part. This mechanism notably takes up a substantial portion of the length of the container.

The present invention aims at providing a medication container which may have a high child resistance without increasing to a large extent the size of the container.

To this end, the present invention proposes a container for the delivery of medication, comprising:

- a housing having an open end,
- a support for supporting medication, said support being slidably mounted in the housing,
- first locking means for locking the support in the housing and for unlocking the support so that the support may be slid to the outside of the housing through the open end, said first locking means comprising a first locking member coupled to the housing and a second locking member coupled to the support, said first and second locking members being engageable with each other, and
- at least one button operable to act on the first locking means, said at least one button comprising a first button operable to disengage the first and second locking members, characterised by further comprising:

- second locking means for maintaining engagement between the first and second locking members, and
- a second button operable to act on the second locking means to permit disengaging the first and second locking members by operating the first button.

Typically, the first button is operable to act on the first locking member to disengage the first and second locking members.

The second locking means may be arranged to block the first locking member when an attempt is made to operate the first button while the second button is in a rest position.

Advantageously, the first and second buttons are operable in respective non-parallel directions.

The first and second buttons are preferably operable independently of the support, i.e. without causing a movement of the support.

The first and second buttons are preferably part of respective distinct pieces that are movable relative to each other.

Typically, the first button is a push button and the second button is a slide button.

In an embodiment, the second locking means comprise a surface coupled to the second button and a stop projection coupled to the first locking member, said surface is arranged to block said stop projection when an attempt is made to operate the first button while the second button is in a rest position, and said surface comprises a hole into which the stop projection enters when the second button is in an operated position and the first button is moved to its operated position.

Said surface may further comprise a stop projection which is blocked by the stop projection coupled to the first locking member when the first button is in an intermediate position where the stop projection coupled to the first locking member is blocked by said surface, to prevent the second button from being operated.

In another embodiment, the second locking means comprise first teeth coupled to the second button and second teeth coupled to the first button, the second teeth are out of engagement with the first teeth when the first and second buttons are in a rest position but engage the first teeth when an attempt is made to operate the first button while the second button is in a rest position, to block the first button in an intermediate position where the first locking member still engages the second locking member while locking the second button, and the first teeth are not on the path of the second teeth when the second button is in an operated position thus permitting the first button to be moved from its rest position to an operated position where the first locking member is disengaged from the second locking member.

Advantageously, the first button is provided at a side wall of the housing, said at least one button further comprises a third button provided at another, opposite side wall of the housing, the first locking means further comprise a third locking member coupled to the housing and a fourth locking member coupled to the support, said third and fourth locking members being engageable with each other, and the third button is operable to disengage the third and fourth locking members.

The third button may be operable to act on the third locking member to disengage the third and fourth locking members.

Preferably, the first and third buttons are arranged to unlock the support only when simultaneously in an operated position.

The container may further comprise third locking means for maintaining engagement between the third and fourth locking members and a fourth button operable to act on the third locking means to permit disengaging the third and fourth locking members by operating the third button.

The third button may be operable to act on the third locking member to disengage the third and fourth locking members and the third locking means may be arranged to block the third locking member when an attempt is made to operate the third button while the fourth button is in a rest position.

Typically, the first and third buttons are push buttons and the second and fourth buttons are slide buttons.

The second and fourth buttons may be provided at a top wall of the housing.

In an embodiment, the second locking means comprise a first surface coupled to the second button and a first stop projection coupled to the first locking member, the first surface is arranged to block the first stop projection when an attempt is made to operate the first button while the second button is in a rest position, the first surface comprises a hole into which the first stop projection enters when the second button is in an operated position and the first button is moved to its operated position, the third locking means comprise a second surface coupled to the fourth button and a second stop projection coupled to the third locking member, the second surface is arranged to block the second stop projection when an attempt is made to operate the third button while the fourth button is in a rest position, and the second surface comprises a hole into which the second stop projection enters when the fourth button is in an operated position and the third button is moved to its operated position.

The first surface may further comprise a third stop projection which is blocked by the first stop projection when the first button is in an intermediate position where the first stop projection is blocked by the first surface, to prevent the second button from being operated, and the second surface may further comprise a fourth stop projection which is blocked by the second stop projection when the third button is in an intermediate position where the second stop projection is blocked by the second surface, to prevent the fourth button from being operated.

In another embodiment, the second locking means comprise first teeth coupled to the second button and second teeth coupled to the first button, the second teeth are out of engagement with the first teeth when the first and second buttons are in a rest position but engage the first teeth when an attempt is made to operate the first button while the second button is in a rest position, to block the first button in an intermediate position where the first locking member still engages the second locking member while locking the second button, the first teeth are not on the path of the second teeth when the second button is in an operated position thus permitting the first button to be moved from its rest position to an operated position where the first locking member is disengaged from the second locking member, the third locking means comprise third teeth coupled to the fourth button and fourth teeth coupled to the third button, the fourth teeth are out of engagement with the third teeth when the third and fourth buttons are in a rest position but engage the third teeth when an attempt is made to operate the third button while the fourth button is in a rest position, to block the third button in an intermediate position where the third locking member still engages the fourth locking member while locking the fourth button, and the third teeth are not on the path of the fourth teeth when the fourth button is in an operated position thus permitting the third button to be moved from its rest position to an operated position where the third locking member is disengaged from the fourth locking member.

In another embodiment, the second and fourth buttons are one and a same button.

According to still another embodiment, the container comprises, besides the first and second locking means and the first and second buttons as defined in the beginning, third locking means for locking the second locking means and a third button operable to act on the third locking means to unlock the second locking means and permit acting on the second locking means by operating the second button.

The third locking means may comprise a third locking member coupled to the second locking means and a fourth locking member coupled to the third button, these third and fourth locking members being engaged with each other when the second and third buttons are in a rest position and being disengageable from each other by operating the third button.

Typically, the third and fourth locking members each comprise teeth.

The first and third buttons may be provided at side walls of the housing and the second button may be provided at a top wall of the housing.

The first and third buttons may be push buttons and the second button may be a slide button.

The first locking means may further comprise a fifth locking member coupled to the housing and a sixth locking member coupled to the support and the third button may be arranged to also disengage the fifth and sixth locking members when operated.

The third button may be arranged to act on the fifth locking member when operated, to disengage the fifth and sixth locking members.

In all embodiments above, the various buttons may each be subject to the action of elastic return means. Moreover, said buttons may each be operable independently of the support and may be part of respective distinct pieces that are movable relative to each other.

The container may further comprise a cap coupled to the support and which closes the open end of the housing when the support is in its locked position.

Typically, the support supports at least one blister card containing the medication, for example several separate blister cards containing the medication and placed side-by-side. The blisters of said at least one blister card are preferably fully encased in the housing when the support is in its locked position.

The medication may be in the form of capsules or tablets.

Advantageously, the container contains an even number of tablets.

The container may contain 2 to 14 tablets, preferably 6 to 10 tablets, most preferably 10 tablets.

The container according to the invention is particularly suitable for containing drug for the treatment of cancer, drug having an immediate toxic effect or drug having an effect on the immune system.

According to a particular embodiment, the medication comprises Cladribine or derivatives thereof.

The container according to the invention typically has a wallet size, preferably a length between 119 and 222 mm, a width between 52 and 98 mm and a thickness between 10 and 21 mm.

The present invention further provides a kit comprising separately a container as defined above and medication. Preferably, the kit comprises a description, for example on a separate sheet, containing information on how to handle the container and on the administration and dosing of the medication.

The present invention further provides a method of opening a container as defined above comprising first and third buttons and a second button for blocking/unblocking the first and third buttons, the method being characterised by comprising the following steps:

holding the housing, operating the second button, operating the first and third buttons while the second button is in its operated position, and pulling the support while the first and third buttons are in their operated position.

The present invention further provides a method of opening a container as defined above comprising a first button, a second button for blocking/unblocking the first button and a third button for blocking/unblocking the second button, the method being characterised by comprising the following steps:

holding the housing, operating successively the third button, the second button and the first button, and pulling the support while the first and third buttons are in their operated position.

Other features and advantages of the present invention will be apparent upon reading the following detailed description of preferred embodiments made with reference to the appended drawings in which.

Figure 5:
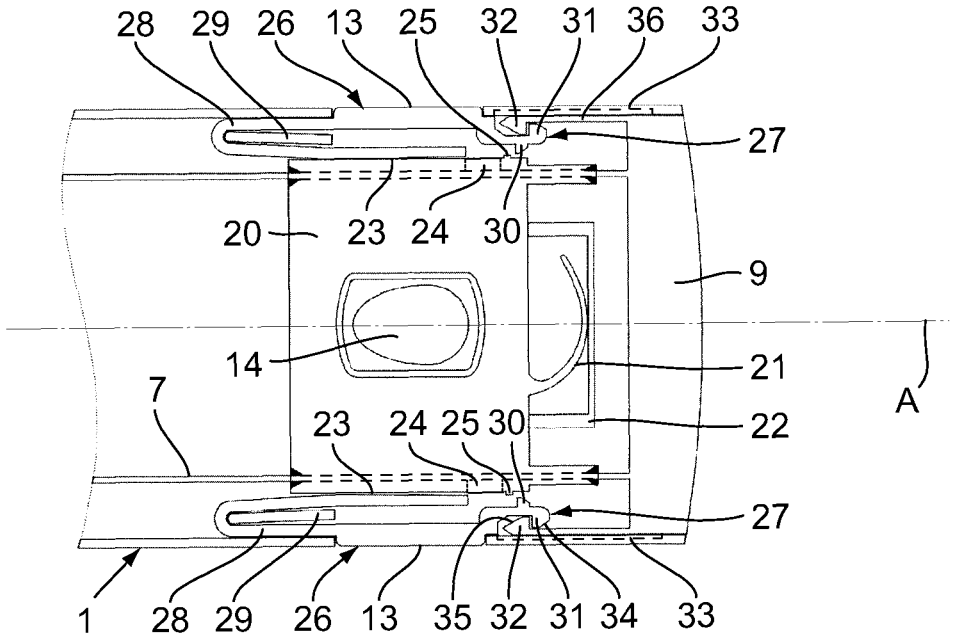
FIG. 5 is a diagrammatic top view of the internal mechanism for opening/closing the child-resistant medication container according to the first embodiment of the invention.
Figure 6:
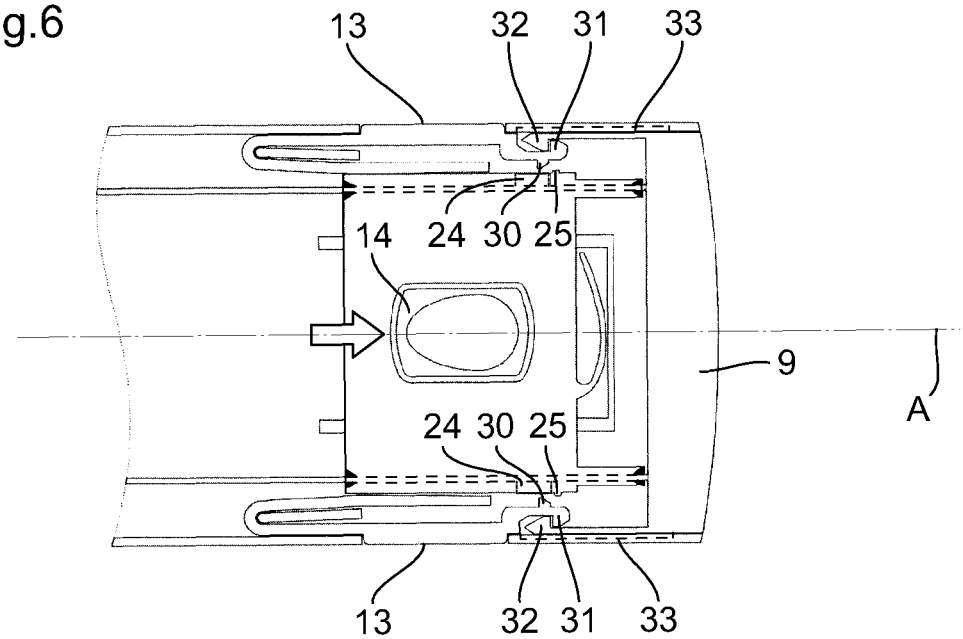
Figure 7:
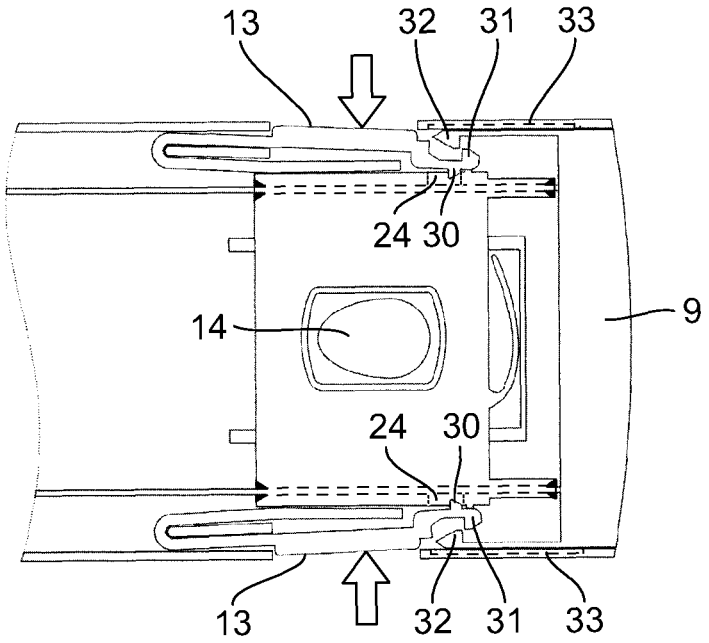
Figure 8:
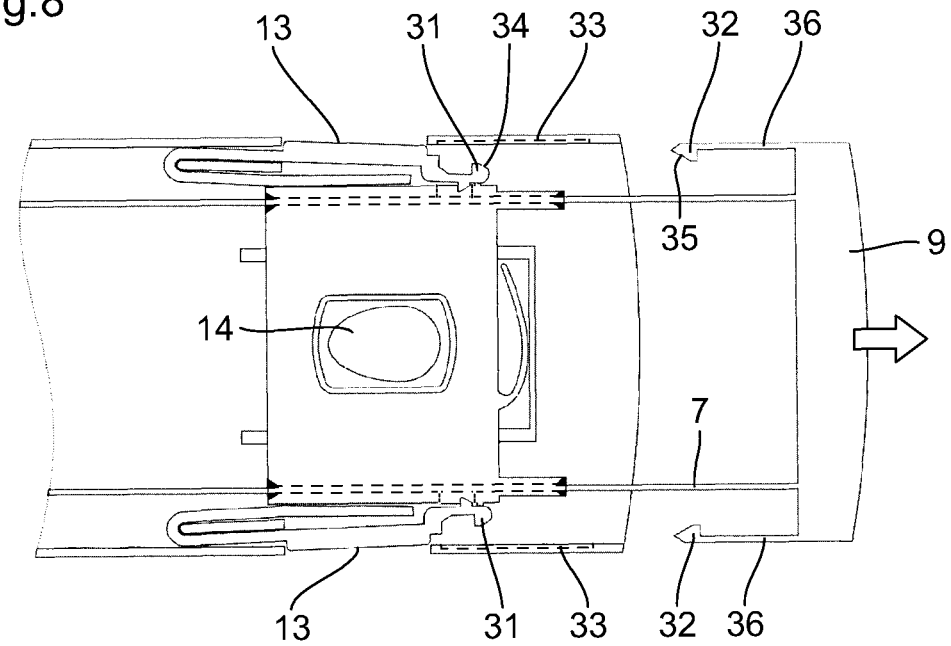
Figure 9:
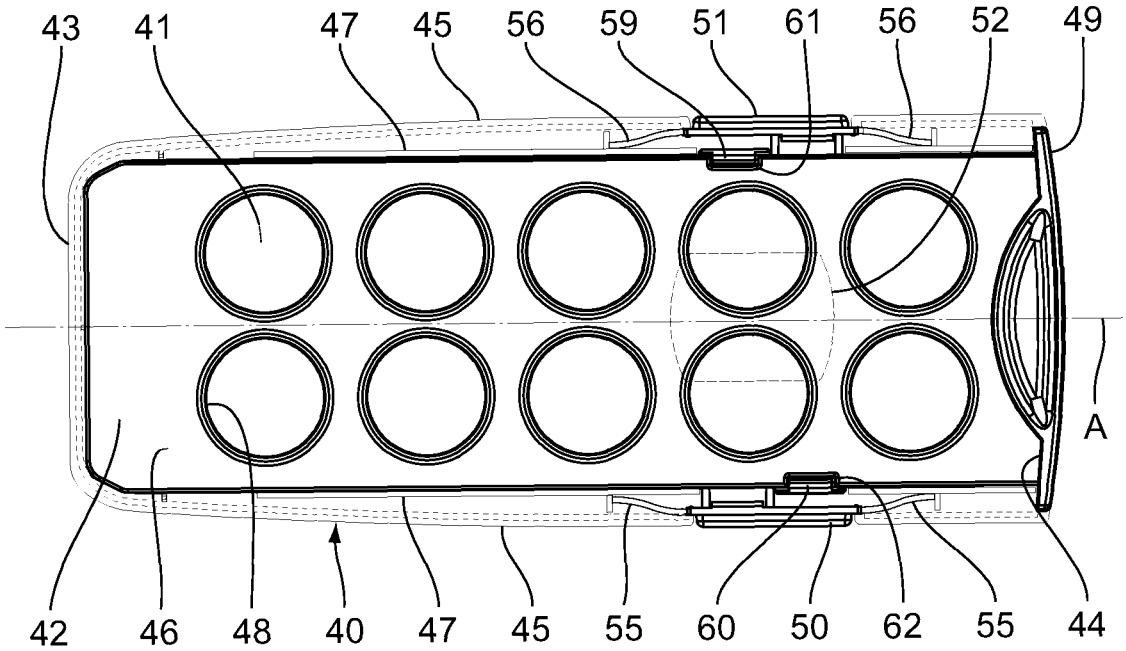
Figure 10:
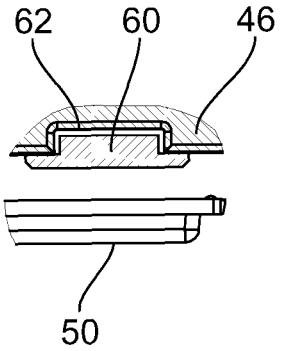
Figure 11:
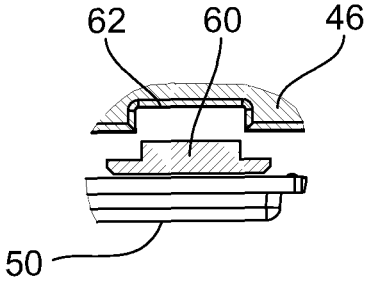
Figure 12:
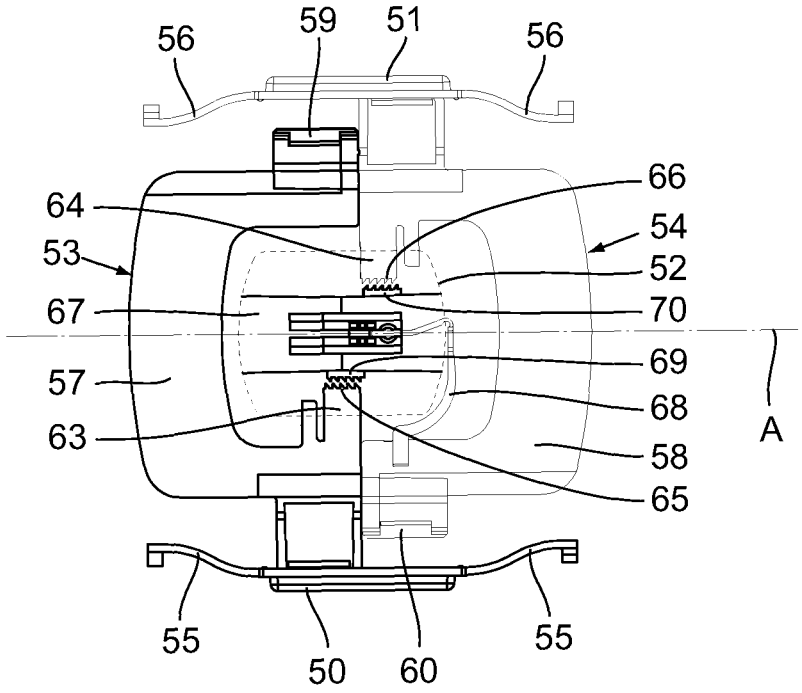
Figure 13:
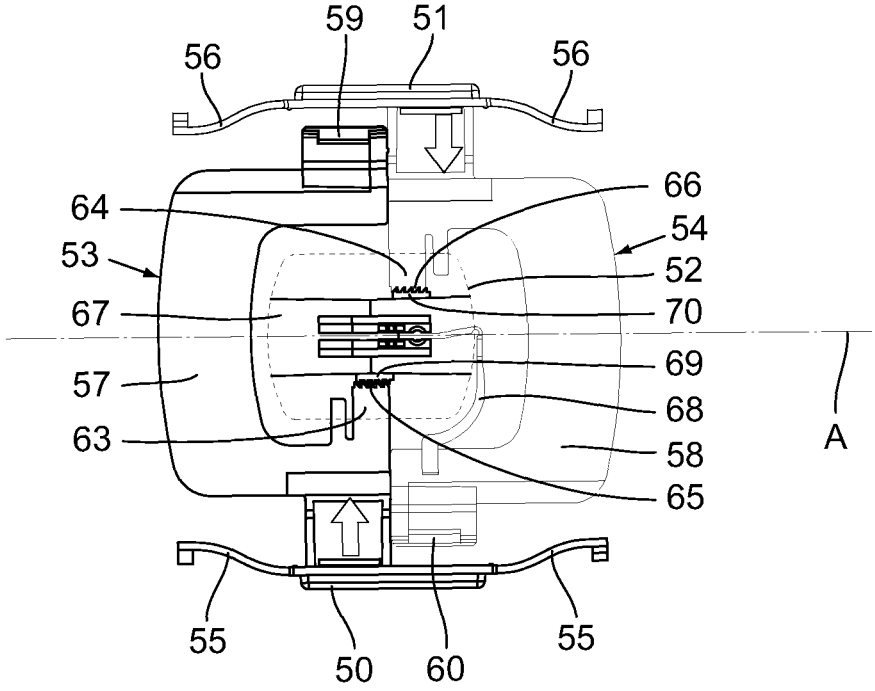
Figure 14:
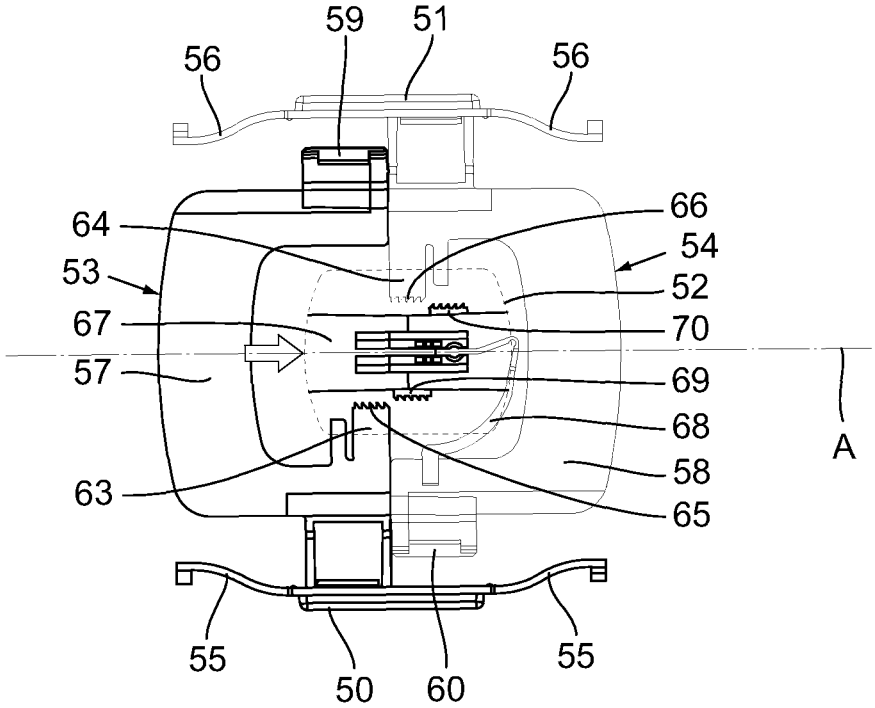
Figure 15:
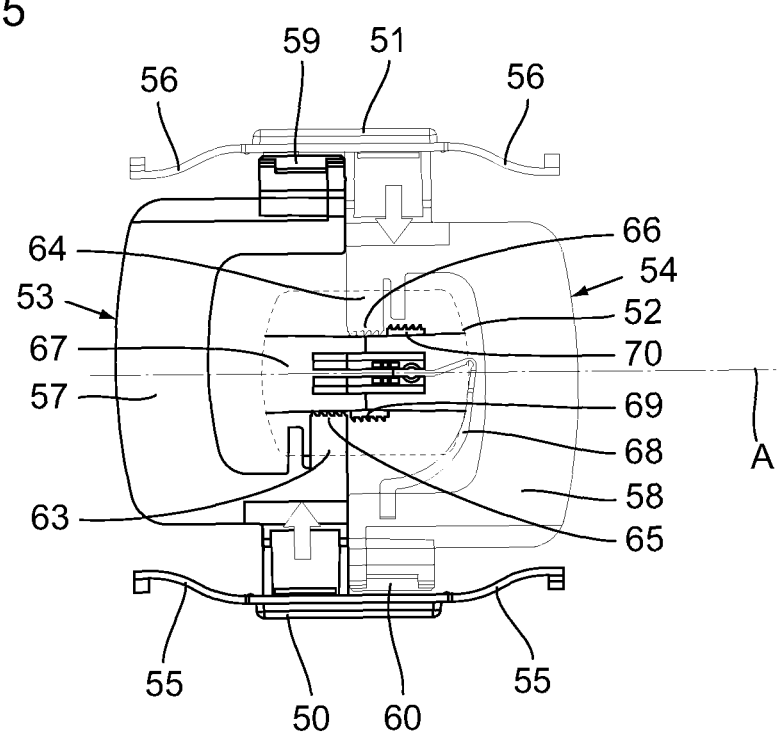
Figure 16:
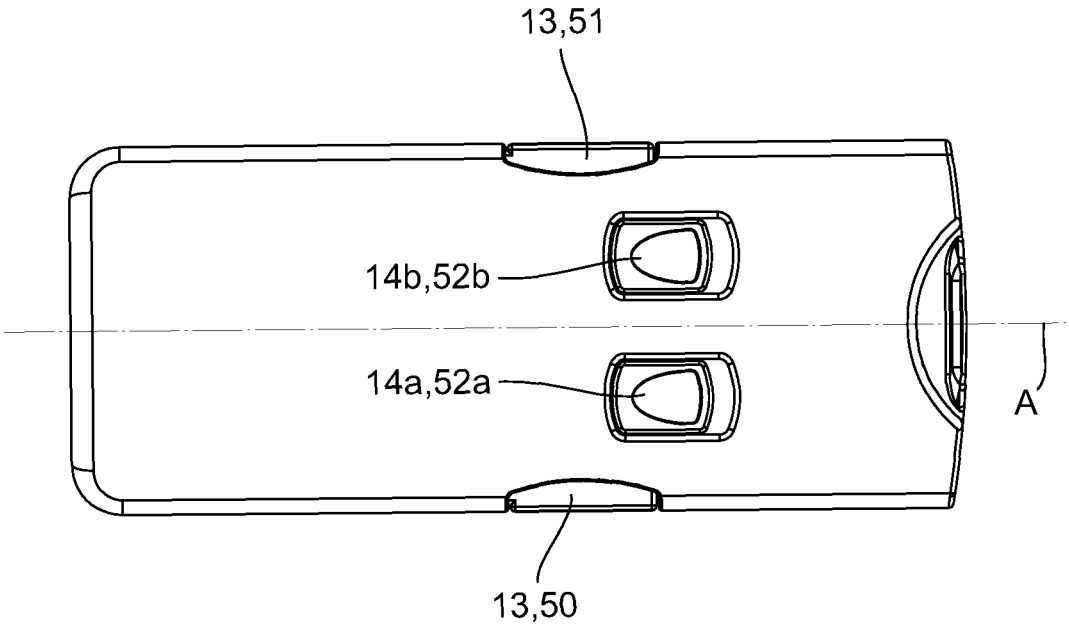
Figure 17:
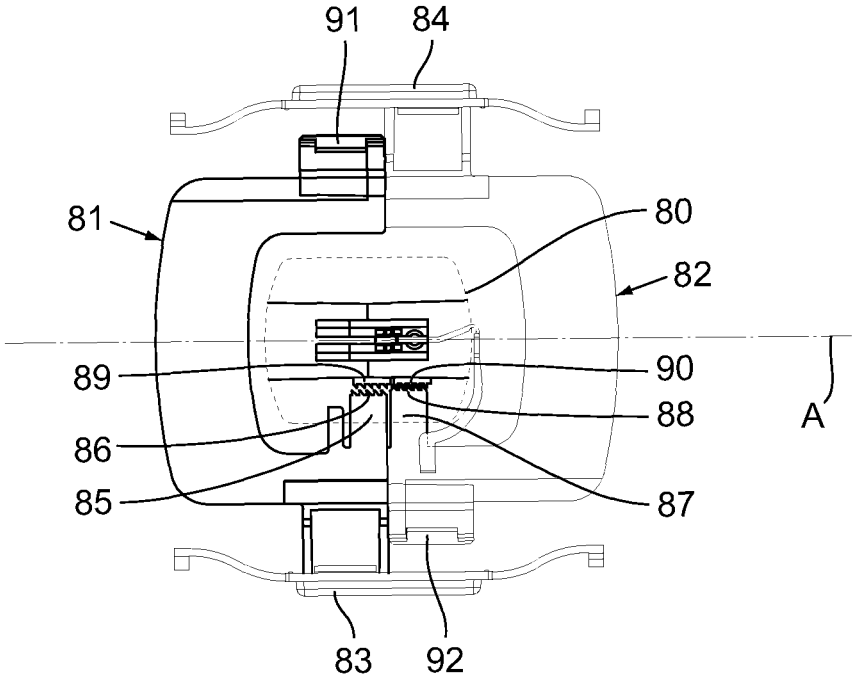
Figure 18:
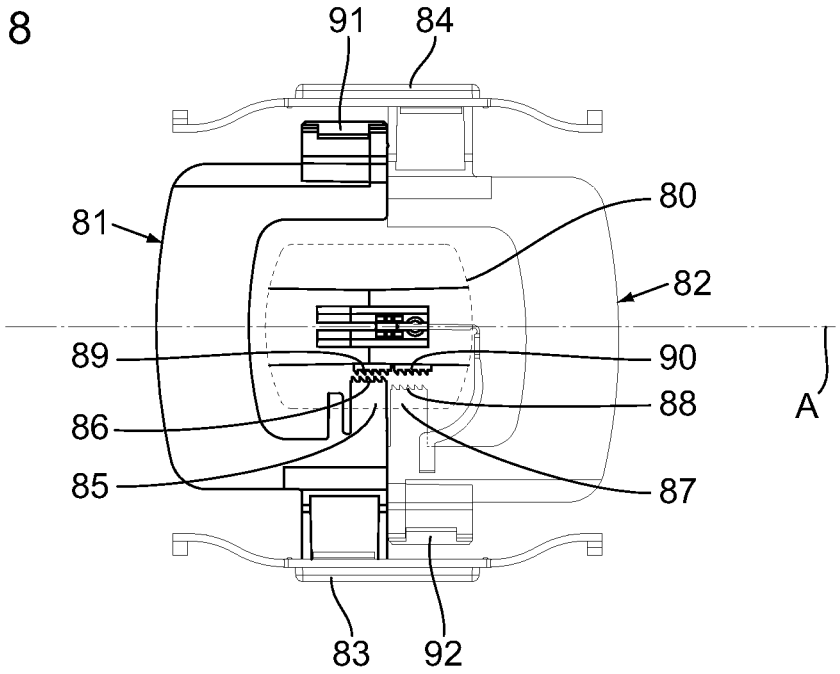
Figure 19:
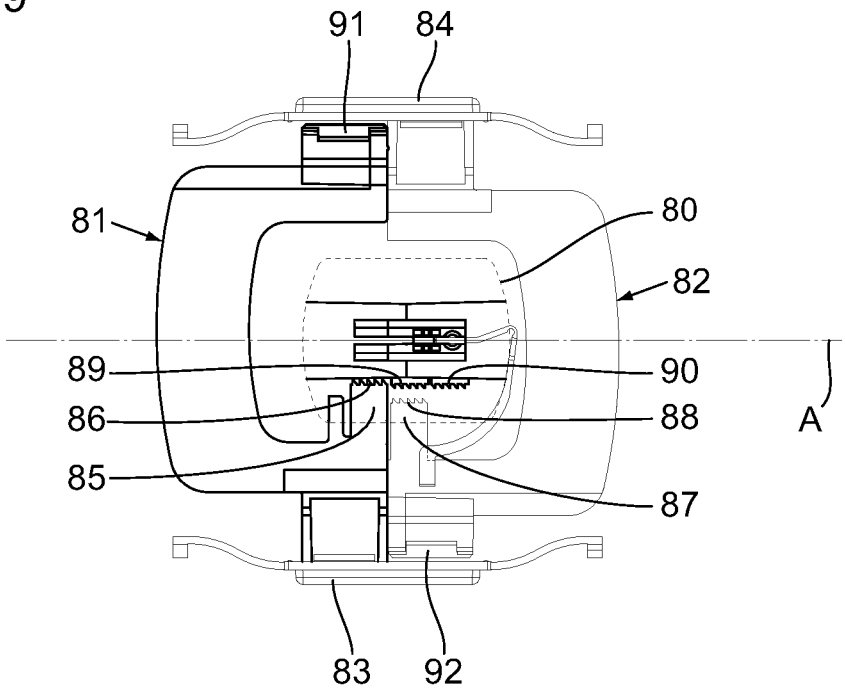

FIGS. 6 to 8 diagrammatically show in top view the successive configurations of the internal mechanism of FIG. 5 during the said sequence of operations;

FIG. 9 is a bottom view of a child-resistant medication container according to a second embodiment of the invention, in a closed position;

FIG. 10 is a partial sectional view showing in an enlarged manner a detail of FIG. 9, namely a locking member located on a housing of the container and engaged with a locking notch located on a tray of the container;

FIG. 11 is a partial sectional view showing the locking member and locking notch of FIG. 10 in a position where they are disengaged from one another;

FIG. 12 is a bottom view of the internal mechanism for opening/closing the child-resistant medication container according to the second embodiment of the invention, said mechanism being shown in a rest position;

FIG. 13 is a bottom view of the internal mechanism for opening/closing the child-resistant medication container according to the second embodiment of the invention, said mechanism being shown in a position corresponding to a wrong opening action by the user;

FIGS. 14 and 15 are bottom views of the internal mechanism for opening/closing the child-resistant medication container according to the second embodiment of the invention, said mechanism being shown respectively during right successive actions performed by the user to open the container;

FIG. 16 is a top view of a child-resistant medication container according to a variant of the first and second embodiments;

FIG. 17 is a bottom view of the internal mechanism for opening/closing a child-resistant medication container according to a third embodiment of the invention, said mechanism being shown in a rest position; and FIGS. 18 and 19 are bottom views of the internal mechanism for opening/closing the child-resistant medication container according to the third embodiment of the invention, said mechanism being shown respectively during successive actions performed by the user to open the container.

Figure 1:
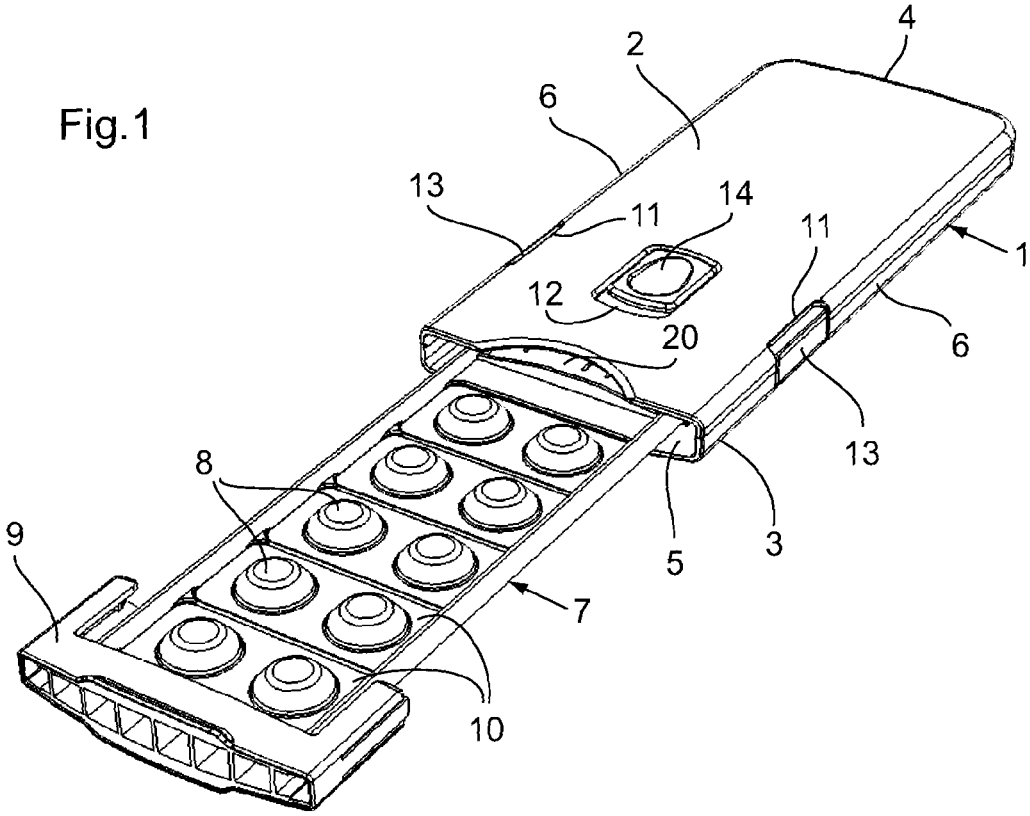
FIG. 1 is a perspective view of a child-resistant medication container according to a first embodiment of the invention, in an open position.
Figure 2:
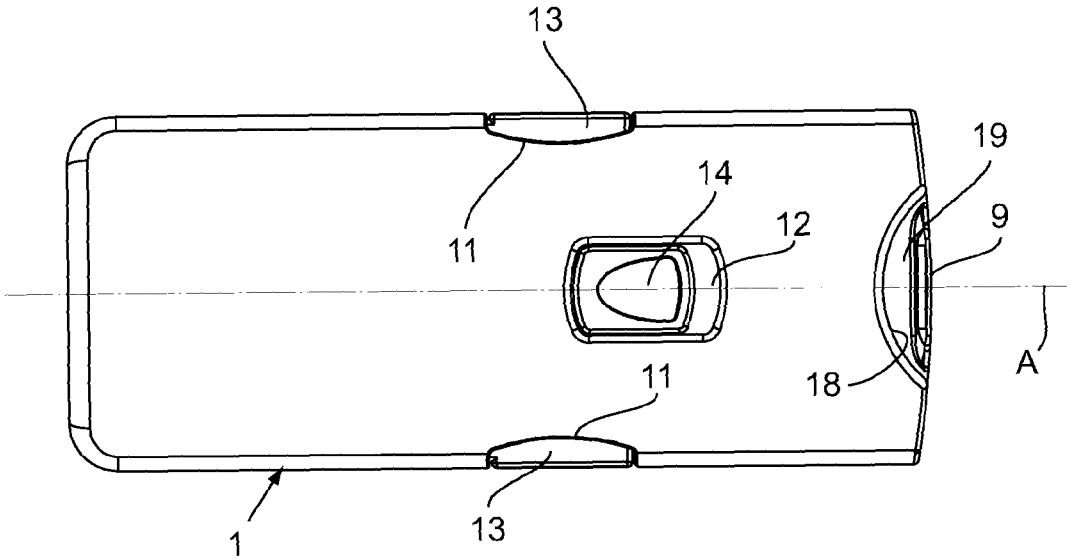
FIG. 2 is a top view of the child-resistant medication container according to the first embodiment of the invention, in a closed position.

With reference to FIGS. 1 and 2, a child-resistant medication container according to a first embodiment of the invention comprises a housing 1 made of a top part and a bottom part assembled together. The housing 1 is of a generally parallelepipedic shape and comprises a top wall 2 and a base wall 3 opposite to one another, a closed end 4 and an open end 5 opposite to one another, and two opposite side walls 6. A tray 7 supporting blisters 8 is slidably guided in the housing 1 along a longitudinal axis A of the container. The tray 7 may take a locked position, corresponding to a closed position of the container, in which the tray 7 is locked inside the housing 1, preventing access to the blisters 8 (FIG. 2). The tray 7 may also be unlocked and then slid toward the outside of the housing 1 through the open end 5 to permit access to the blisters 8 (open position of the container; FIG. 1). A cap 9 is coupled to the front end of the tray 7. The cap 9 closes the open end 5 when the tray 7 is in its locked position. The cap 9 may be of one-piece construction with the tray 7.

Each blister 8 contains a dose of solid medication. The tray 7 comprises holes (not shown) under the blisters 8 through which the doses of solid medication may be expelled when the container is in its open position, by applying a pressure on the blisters 8. In the example shown, the blisters 8 are arranged in pairs, each pair being defined by a separate blister card 10 fixed, e.g. snapped, on the tray 7. The blister pairs or cards 10 are aligned side by side so as to form two blister rows as shown in FIG. 1. Such an arrangement of the blisters 8, comprising several separate blister cards 10, facilitates the management of the quantities of medication and permits reducing medication wastage. In a variant, however, a single blister card could be provided on the tray 7, as is conventional.

Figure 3:
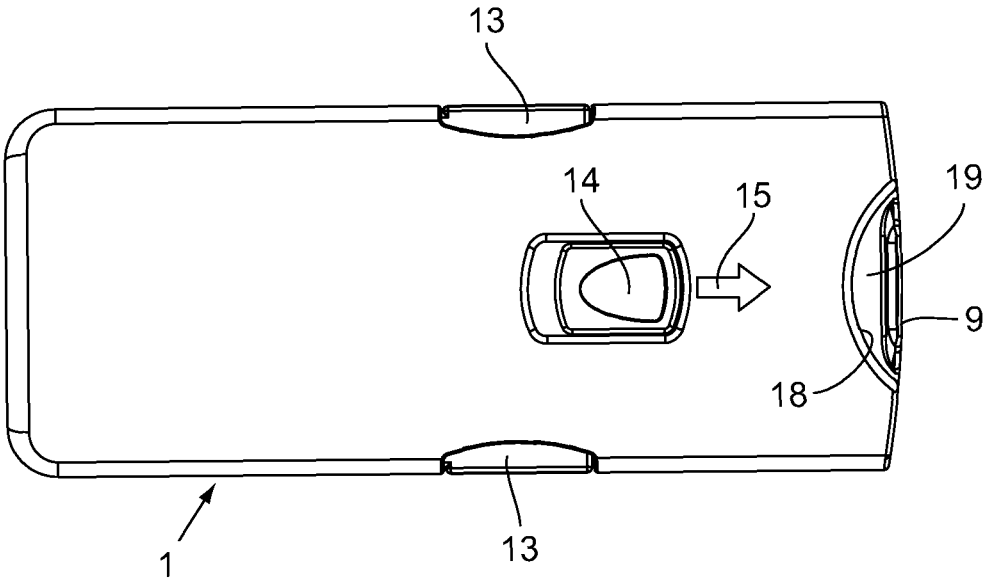
FIGS. 3 and 4 show in top view a sequence of operations required to open the child-resistant medication container according to the first embodiment of the invention.
Figure 4:
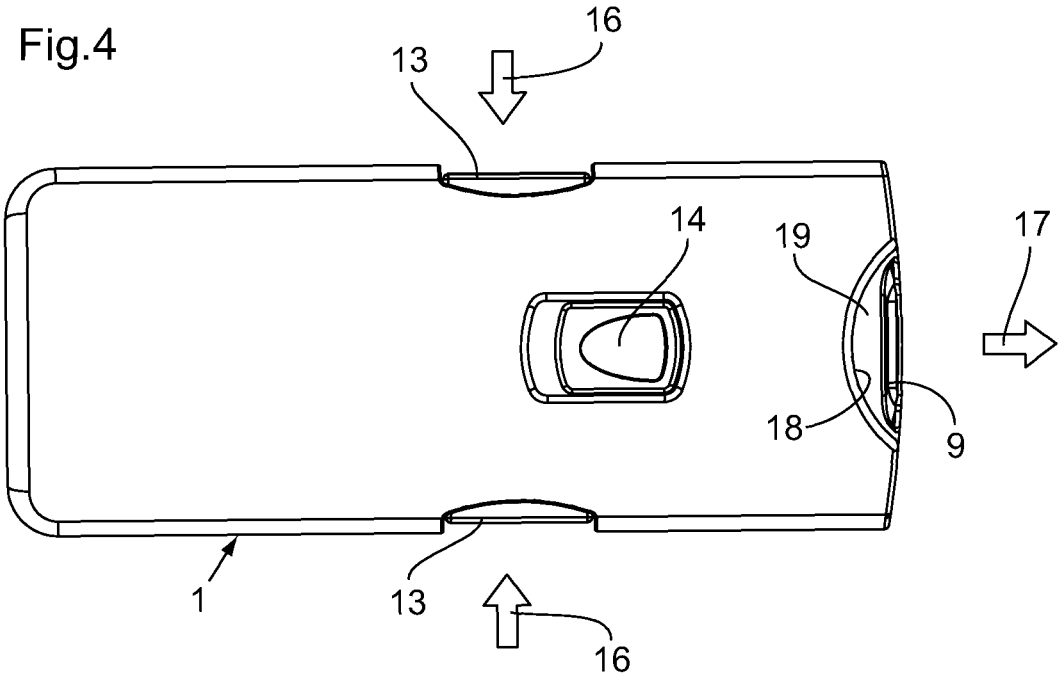

The housing 1 includes opposite openings 11 in the side walls 6 and an opening 12 in the top wall 2. Push buttons 13 are provided in the openings 11, respectively, and a slide button 14 is provided in the opening 12. In the context of the invention, the term "button" is to be understood in a broad sense, as covering any part on which a finger can rest to transmit a force. The lateral push buttons 13 are operable by being moved substantially perpendicularly to the longitudinal axis A toward the inside of the housing 1. The slide button 14 is operable by being moved along the longitudinal axis A. To open the container, the user must perform the following sequence of operations:

operate the slide button 14 as shown by arrow 15 in FIG. 3, then operate the lateral push buttons 13 as shown by arrows 16 in FIG. 4 while maintaining the slide button 14 in its operated position, and then pull the tray 7 as shown by arrow 17 while maintaining the lateral push buttons 13 in their operated position.

Once the lateral push buttons 13 are operated, the user may release the slide button 14. Maintaining the lateral push buttons 13 in their operated position is required only at the beginning of pulling the tray 7, to unlock the latter. Then the tray 7 may be freely moved toward the outside of the housing 1 without maintaining pressure on the push buttons 13. Typically, the container is held in one hand with the thumb and another finger of the hand acting on the lateral push buttons 13 and a finger of the other hand acting on the top slide button 14, the said other hand being used to pull the tray 7 after releasing the top slide button 14. Recesses 18 are provided in the top and base walls 2, 3 at the open end 5 to expose surface portions 19 of the cap 9 when the tray 7 is in its locked position and to thereby facilitate seizing the tray 7.

It will thus be appreciated that three successive actions have to be performed by the user, in a determined order, to unlock and move the tray 7. As will be explained below, operating the lateral push buttons 13 while the slide button 14 is not in its operated position is not possible because the slide button 14, in its rest position, blocks the lateral push buttons 13 and prevents them from moving beyond an intermediate pressed position in which the tray 7 is still locked. Operating the slide button 14 while a pressure is applied on one or two of the lateral push buttons 13 is not possible either, because the lateral push buttons 13, in their intermediate pressed position, block the slide button 14. Merely operating the slide button 14 frees the lateral push buttons 13 but does not free the tray 7. Simultaneous pressure holding on the operated lateral push buttons 13 and pulling action on the tray 7 are required to initiate the movement of the tray 7. A friction is preferably provided between the tray 7 and the housing 1 so that the tray 7 cannot be moved merely by inclining the container downward while the lateral push buttons 13 are in their operated position.

A child will generally not have the manual dexterity nor the cognitive knowledge to perform the above-described sequence of operations required to unlock and move the tray 7. Moreover, the housing 1 may be made sufficiently wide for the lateral buttons 13 to be separated by a large distance, thereby making it impossible for a child to hold the container in one hand and to press the lateral buttons 13 while holding the slide button 14 in its operated position or to pull the tray 7 while pressing the lateral buttons 13. It should also be noted that in the closed position of the container the blisters 8 are fully encased in the housing 1 and thus cannot be accessed.

The internal mechanism allowing the above-described sequence of operations is diagrammatically shown in FIGS. 5 to 8. The slide button 14 projects from and is rigidly connected to a plate 20 that is slidably guided in the housing 1 above the blisters 8 along the longitudinal axis A of the container. A return spring 21 is provided between the front end of the plate 20 and a bearing part 22 rigidly connected to the inner face of the top wall 2 of the housing 1. The return spring 21 may be a leaf spring made of one-piece construction with the plate 20 and the button 14, as shown. Alternatively, it could be a conventional metal leaf or helical spring disposed between the front end of the plate 20 and the bearing part 22. The two side surfaces 23 of the plate 20 along the longitudinal axis A of the container include respective opposite holes 24 and, between the holes 24 and the front end of the plate 20, respective stop projections 25.

Each lateral push button 13 is part of a piece 26 comprising, inside the housing 1, a locking part 27 and a return U-bent leaf spring 28 extending between a corresponding side surface 23 of the plate 20 and the button 13. The piece 26 is held by a part 29 rigidly connected to the housing 1. The locking part 27 comprises a stop projection 30 extending toward the inside of the housing 1 perpendicularly to the longitudinal axis A and a locking member 31 extending toward the outside of the housing 1 perpendicularly to the longitudinal axis A. The locking member 31 engages a corresponding locking member 32 of the cap 9 to lock the tray 7, as is shown in FIG. 5. The locking member 32 extends toward the inside of the housing 1 perpendicularly to the longitudinal axis A and is located at the end of an arm 36 of the cap 9. The stop projection 30 has two functions. A first function is to come into abutment against the corresponding side surface 23 of the plate 20 when the push button 13 is pressed and the slide button 14 is in its rest position, shown in FIG. 5, to prevent the piece 26 and the push button 13 from going beyond the aforementioned intermediate pressed position in which the locking member 31 still engages the locking member 32, in other words to prevent disengagement of the locking members 31, 32. The second function is to block the stop projection 25 when the slide button 14 is moved toward its operated position while the push button 13 is held in its intermediate pressed position, thereby preventing the slide button 14 from reaching its operated position.

When the push buttons 13 are in their rest position, the stop projections 30 do not interrupt the paths of the stop projections 25 and therefore do not hinder the movement of the slide button 14, which can thus be moved along the longitudinal axis A of the container up to its operated position. When the slide button 14 is in its operated position (FIG. 6), the stop projections 30 face the holes 24. In this configuration, if the lateral push buttons 13 are pressed, the stop projections 30 will enter the holes 24, enabling the pieces 26 and push buttons 13 to go beyond the aforementioned intermediate position and to reach their operated position, shown in FIG. 7. In this operated position, the locking members 31 are out of engagement with the locking members 32 and the tray 7 is therefore free. The tray 7 may thus be slid out to expose the blisters 8 (FIG. 8). The side surfaces 23 of the plate 20, with their holes 24 and their surfaces of contact with the stop projections 30, thus constitute locking means serving to prevent the locking members 31 from disengaging from the locking members 32 or to enable such a disengagement.

So long as the lateral push buttons 13 are held in their operated position, the slide button 14 is blocked in its operated position due to the cooperation between the stop projections 30 and the holes 24. Once the buttons 13, 14 have been released by the user, they are returned to their respective rest positions by the springs 28, 21. The tray 7 may be returned to its locked position merely by pushing it back toward the inside of the housing 1. The internal faces of the side walls 6 of the housing 1 have recesses 33. The locking members 31, 32 have slanted surfaces 34, 35 (see FIG. 8) that cooperate when the tray 7 is pushed back while the buttons 13 are in their rest position, causing the arms 36 of the cap 9 to deform externally into the recesses 33 until the locking members 32 recover their locked position in which they engage the locking members 31.

With reference to FIG. 9, a child-resistant medication container according to a second embodiment of the invention comprises a housing 40 having a top wall 41, a base wall 42 opposite to the top wall 41, a closed end 43, an open end 44 opposite to the closed end 43, and two opposite side walls 45. A tray 46 supporting blisters (not shown) is slidably guided in the housing 40 along a longitudinal axis A of the container between two guiding internal longitudinal walls 47 of the housing 40. In the illustrated example, the base wall 42 of the housing 40 is transparent and the tray 46 is therefore visible when the container is viewed from below. As in the first embodiment, the tray 46 may take a locked position (FIG. 9) corresponding to a closed position of the container, in which the tray 46 is locked inside the housing 40, preventing access to the blisters. The tray 46 may also be unlocked and slid toward the outside of the housing 40 through the open end 44 to permit access to the blisters (open position of the container). The tray 46 comprises holes 48 under the blisters through which the medication contained in the blisters may be expelled when the container is in its open position, by applying a pressure on the blisters. A cap 49 is coupled to the front end of the tray 46. The cap 49 closes the open end 44 when the tray 46 is in its locked position. The cap 49 may be of one-piece construction with the tray 46.

The housing 40 includes opposite openings in the side walls 45 in which push buttons 50, 51 are provided and an opening in the top wall 41 in which a slide button 52 is provided. The lateral push buttons 50, 51 are operable by being moved perpendicularly to the longitudinal axis A toward the inside of the housing 40. The slide button 52 is operable by being moved along the longitudinal axis A. To open the container, the user must perform the same sequence of operations as in the first embodiment, namely:

operate the slide button 52, then operate the lateral push buttons 50, 51 while maintaining the slide button 52 in its operated position, and then pull the tray 46 while maintaining the lateral push buttons 50, 51 in their operated position.

The internal mechanism allowing the above-described sequence of operations in this second embodiment is shown in FIGS. 10 to 15. The lateral push buttons 50, 51 are part of two respective pieces 53, 54. For the purpose of clarity, the pieces 53, 54 are shown with different line thicknesses in the drawings. Each piece 53, 54 comprises a pair of return springs 55, 56 extending from opposite sides of the corresponding button 50, 51. The respective free ends of the springs 55 bear against the external face of one of the guiding walls 47. The respective free ends of the springs 56 bear against the external face of the other guiding wall 47. Each piece 53, 54 comprises a U-shaped flat portion 57, 58 located inside the housing 40 on or near the internal face of the top wall 41, i.e. between the blisters and the top wall 41. The U-shaped flat portions 57, 58 are oriented along the longitudinal axis A of the container in an opposite manner to each other. Each U-shaped flat portion 57, 58 is so wide as to connect the corresponding button 50, 51 provided on one side of the tray 46 to a locking member 59, 60 of the piece 53, 54 provided on the other side of the tray 46. Each locking member 59, 60 is in the form of a hook projecting from the flat portion 57, 58 toward the base wall 42. In the closed position of the container, each locking member 59, 60 engages a respective notch 61, 62 formed in the respective lateral side of the tray 46 to lock the latter (FIGS. 9 and 10).

Each piece 53, 54 further comprises a portion 63, 64 located in the same plane as the U-shaped flat portion 57, 58 and projecting toward the inside of the housing 40 in a direction perpendicular to the longitudinal axis A of the container from the one of the two legs of the U-shaped flat portion 57, 58 that is closer to the button 50, 51. Each projecting portion 63, 64 is terminated by teeth 65, 66 aligned in a direction parallel to the longitudinal axis A. The slide button 52 comprises an external portion (shown in dashed line) located on the external face of the top wall 41 to be directly accessible to the user and an internal portion 67 located and guided inside the housing 40. A return spring 68 which may be of one-piece construction with the piece 54 is attached at one of its ends to the U-shaped flat portion 58 and at its other end to the internal portion 67 of the slide button 52. The internal portion 67 comprises first teeth 69 at one its lateral sides and second teeth 70 at its other lateral side. In the rest position of the slide button 52 and of the lateral buttons 50, 51, the first teeth 69 respectively face the spaces between the teeth 65 of the piece 53 but do not engage them because a distance is provided in a direction perpendicular to the longitudinal axis A between the teeth 65 and the teeth 69. Likewise, in the rest position of the slide button 52 and of the lateral buttons 50, 51, the second teeth 70 respectively face the spaces between the teeth 66 of the piece 54 but do not engage them because a distance is provided in a direction perpendicular to the longitudinal axis A between the teeth 66 and the teeth 70. In the rest position of the slide button 52 (FIG. 12), if the lateral buttons 50, 51 are pressed, the pieces 53, 54 are moved in opposite directions perpendicular to the longitudinal axis A, namely in directions in which the locking members 59, 60 start to disengage from the notches 61, 62 respectively. However, the movement of the pieces 53, 54 is stopped in an intermediate position thereof where the teeth 65, 66 have respectively engaged the teeth 69, 70, i.e. have entered the spaces between the teeth 69, 70, and rest against the bottom of said spaces (FIG. 13). In this intermediate position, the locking members 59, 60 are not fully disengaged from the notches 61, 62 and, therefore, the tray 46 remains locked. Moreover, the slide button 52 is locked by the teeth 65, 66 engaging the teeth 69, 70 and, therefore, cannot be operated by the user.

From the configuration of the container where the slide button 52 and the lateral buttons 50, 51 are in their rest position (FIG. 12), the slide button 52 may be operated, i.e. moved along the longitudinal axis A up to a position where it is in abutment against a bearing portion (not shown) of the top wall 41 (FIG. 14). In this operated position, the teeth 69, 70 are no longer on the path of the projecting portions 63, 64, respectively, and the pieces 53, 54 may thus be moved beyond their intermediate position if the lateral buttons are pressed (FIG. 15). The limit position of the lateral buttons 50, 51, more generally of the pieces 53, 54, is defined by the teeth 65, 66 abutting the sides of the internal portion 67 of the slide button 52 or by the lateral buttons 50, 51 abutting the internal walls 47 of the housing 40. This limit position is the operated position of the lateral buttons 50, 51. In this position, the locking members 59, 60 are fully disengaged from the notches 61, 62 respectively (FIG. 11). The tray 46 is therefore unlocked and may be pulled to the outside of the housing 40 through the open end 44.

One will note that full operation of the slide button 52 is necessary for unlocking the lateral buttons 50, 51, i.e. for allowing them to go beyond their intermediate position. If indeed the slide button 52 is not fully operated, some of the teeth 69 (respectively 70) will remain on the path of the projecting member 63 (respectively 64) and pressing the lateral buttons 50, 51 will result in these buttons being stopped in their intermediate position and in the slide button 52 being locked.

As soon as the lateral buttons 50, 51 are released from their operated position or from their intermediate position, the return springs 55, 56 bring them back to their rest position. Likewise, the slide button 52 is returned to its rest position by the return spring 68 as soon as it is released if the lateral buttons 50, 51 are in their rest position. When the lateral buttons 50, 51 are in their operated position, the slide button 52 is retained in its operated position by the projecting portions 63, 64 as shown in FIG. 15.

FIG. 16 shows a variant of the first and second embodiments in which the sole slide button 14, respectively 52, has been replaced by two slide buttons 14*a*, 14*b*, respectively 52*a*, 52*b*. These slide buttons are located on the top wall of the housing and are both operable along the longitudinal axis A. The internal locking/unlocking mechanism is identical to that of the first or the second embodiment described above, except that the part 20, respectively 67, is divided into two separate and independent parts rigidly connected with the slide buttons respectively and each comprising locking means for a respective lateral button.

In each of the first and second embodiments, although it is preferable to have two lateral buttons and two corresponding locking members, one of these buttons and the corresponding piece could be suppressed. In this case, a high level of security would nevertheless still be achieved because a specific sequence of operations, namely operating a first button and then a second button, would be required to unlock the tray. The fact that said first and second buttons are operable in non-parallel directions still increases the security or child resistance. Moreover, at least one of said first and second buttons could be concealed, for example by being recessed with respect to the corresponding wall of the housing.

FIG. 17 shows a child-resistant medication container according to a third embodiment of the invention. The container according to this third embodiment has a housing (not shown), a tray (not shown) for supporting blisters and an opening mechanism comprising a slide button 80 and pieces 81, 82 defining lateral push buttons 83, 84 respectively. The housing, the tray and the piece 81 are respectively identical to the housing 40, the tray 46 and the piece 53 of the second embodiment. In particular, the piece 81 comprises a projecting portion 85 terminated by teeth 86 corresponding to the projecting portion 63 and its teeth 65 of the second embodiment. The piece 82 differs from the piece 54 of the second embodiment in that it does not have the projecting portion 64 but has another projecting portion 87 terminated by teeth 88 and located on the same side of the slide button 80 as the projecting portion 85 of the other piece 81. The slide button 80 differs from the slide button 52 of the second embodiment in that it does not have the teeth 70 but comprises, in addition to teeth 89 identical to the teeth 69 of the second embodiment, teeth 90 located on the same side as the teeth 89.

In the rest position of the buttons 80, 83, 84, the teeth 90 are engaged by the teeth 88 so that the slide button 80 is locked. Moreover, the lateral button 83 is locked by the slide button 80, i.e. cannot be operated beyond an intermediate position where the teeth 86 engage the teeth 89 and where the corresponding locking member, designated by the reference numeral 91, still engages the corresponding locking notch of the tray. Pressing the lateral button 84 disengages the teeth 88 from the teeth 90 and frees the slide button 80 (FIG. 18). This also disengages the locking member of the piece 82, designated by the reference numeral 92, from the corresponding locking notch of the tray. However, at this stage, the tray remains locked by the locking member 91 of the piece 81 still engaging the corresponding locking notch of the tray. Operating the slide button 80 while the lateral button 84 is operated unlocks the lateral button 83 which may then be pressed beyond its intermediate position up to a position where its locking member 91 is fully disengaged from the corresponding locking notch of the tray (FIG. 19). In the configuration where both lateral buttons 83, 84 are in their operated position, the tray is unlocked and may therefore be slid out of the housing.

Thus, in this third embodiment, four actions have to be performed by the user, in a determined order, to unlock and move the tray. This is one action more than in the first and second embodiments. The child resistance is therefore still improved.

In a variant of this third embodiment, the locking member 92 could be suppressed and the tray could be locked only by the locking member 91.

In all three embodiments of the invention, the lateral push buttons 13, 50, 51, 83, 84 could be of one-piece construction with the housing and could be in the form of tabs defined by cut-outs made in the side walls of the housing and elastically hinged to the rest of the housing.

Furthermore, the housing could have another shape than a parallelepipedic one, for example a cylindrical shape. Since the buttons are operable independently of the tray and are part of respective distinct pieces that are movable relative to each other, a great flexibility is achieved in the designing of the container.

The medication container according to the invention may be made of plastics. Alternatively, the medication container, parts of it and/or the blisters can be made of a light-emitting material.

It will be appreciated that the invention is not limited to containers for medication stored in blisters. The medication could be freely disposed in a tray or other receptacle. Alternatively, the medication could be stored in blisters that are disposed in a tray or other receptacle without being fixed. It could also be envisaged to use the container according to the invention to store a liquid medication container, such as a syringe.

The medication container of the present invention is preferably used for dispensing medication, such as tablets, which may not be suitable or may be dangerous to children. The medication container is therefore most preferably used for anti-cancer drugs, drugs having an immediate toxic effect or drugs having an effect on the immune system, such as purine analogues, in particular Cladribine or derivatives thereof. Cladribine is a chlorinated purine analogue which has been suggested to be useful in the treatment of multiple sclerosis (EP 626 853) and cancer.

The present invention has been described above by way of example only. It will be apparent to the skilled person that modifications may be made without departing from the invention as claimed. In the appended claims, reference numerals in parentheses have been inserted to facilitate the reading. These reference numerals however shall in no manner be construed as limiting the scope of the claims.

The invention claimed is:

1. Container for the delivery of medication, comprising:

a housing having an open end, a support for supporting medication, said support being slidably mounted in the, first locking means for locking the support in the housing and for unlocking the support so that the support may be slid to the outside of the housing through the open end, said first locking means comprising a first locking member coupled to the housing and a second locking member coupled to the support, said first and second locking members being engageable with each other, and at least one button operable to act on the first locking means, said at least one button comprising a first button operable to act on the first locking member to disengage the first and second locking members, characterised by further comprising:

second locking means for maintaining engagement between the first and second locking members, arranged to block the first locking member when an attempt is made to operate the first button while the second button is in a rest position, and a second button operable to act on the second locking means to permit disengaging the first and second locking members by operating the first button.

2. Container according to claim 1, characterised in that the first and second buttons are operable in respective non-parallel directions.

3. Container according to claim 1, characterised in that the first and second buttons are operable independently of the support.

4. Container according to claim 1, characterised in that the first and second buttons are part of respective distinct pieces that are movable relative to each other.

5. Container according to claim 1, characterised in that the first button is a push button and the second button is a slide button.

6. Container according to claim 1, characterised in that the second locking means comprise a surface coupled to the second button and a stop projection coupled to the first locking member, in that said surface is arranged to block said stop projection when an attempt is made to operate the first button while the second button is in a rest position, and in that said surface comprises a hole into which the stop projection enters when the second button is in an operated position and the first button is moved to its operated position.

7. Container according to claim 6, characterised in that said surface further comprises a stop projection which is blocked by the stop projection coupled to the first locking member when the first button is in an intermediate position where the stop projection coupled to the first locking member is blocked by said surface, to prevent the second button from being operated.

8. Container according to claim 1, characterised in that the second locking means comprise first teeth coupled to the second button and second teeth coupled to the first button, in that the second teeth are out of engagement with the first teeth when the first and second buttons are in a rest position but engage the first teeth when an attempt is made to operate the first button while the second button is in a rest position, to block the first button in an intermediate position where the first locking member still engages the second locking member while locking the second button, and in that the first teeth are not on the path of the second teeth when the second button is in an operated position thus permitting the first button to be moved from its rest position to an operated position where the first locking member is disengaged from the second locking member.

9. Container according to claim 1, characterised in that the first button is provided at a side wall of the housing, in that said at least one button further comprises a third button provided at another, opposite side wall of the housing, in that the first locking means further comprise a third locking member coupled to the housing and a fourth locking member coupled to the support, said third and fourth locking members being engageable with each other, and in that the third button is operable to disengage the third and fourth locking members.

10. Container according to claim 9, characterised in that the third button is operable to act on the third locking member to disengage the third and fourth locking members.

11. Container according to claim 9, characterised in that the first and third buttons are arranged to unlock the support only when simultaneously in an operated position.

12. Container according to claim 9, characterised by further comprising third locking means for maintaining engagement between the third and fourth locking members and a fourth button operable to act on the third locking means to permit disengaging the third and fourth locking members by operating the third button.

13. Container according to claim 12, characterised in that the third button is operable to act on the third locking member to disengage the third and fourth locking members and the third locking means are arranged to block the third locking member when an attempt is made to operate the third button while the fourth button is in a rest position.

14. Container according to claim 12, characterised in that the first and third buttons are push buttons and the second and fourth buttons are slide buttons.

15. Container according to claim 14, characterised in that the second and fourth buttons are provided at a top wall of the housing.

16. Container according to claim 12, characterised in that the second locking means comprise a first surface coupled to the second button and a first stop projection coupled to the first locking member, in that the first surface is arranged to block the first stop projection when an attempt is made to operate the first button while the second button is in a rest position, in that the first surface comprises a hole into which the first stop projection enters when the second button is in an operated position and the first button is moved to its operated position, in that the third locking means comprise a second surface coupled to the fourth button and a second stop projection coupled to the third locking member, in that the second surface is arranged to block the second stop projection when an attempt is made to operate the third button while the fourth button is in a rest position, and in that the second surface comprises a hole into which the second stop projection enters when the fourth button is in an operated position and the third button is moved to its operated position.

17. Container according to claim 16, characterised in that the first surface further comprises a third stop projection which is blocked by the first stop projection when the first button is in an intermediate position where the first stop projection is blocked by the first surface, to prevent the second button from being operated, and in that the second surface further comprises a fourth stop projection which is blocked by the second stop projection when the third button is in an intermediate position where the second stop projection is blocked by the second surface, to prevent the fourth button from being operated.

18. Container according to claim 12, characterised in that the second locking means comprise first teeth coupled to the second button and second teeth coupled to the first button, in that the second teeth are out of engagement with the first teeth when the first and second buttons are in a rest position but engage the first teeth when an attempt is made to operate the first button while the second button is in a rest position, to block the first button in an intermediate position where the first locking member still engages the second locking member while locking the second button, in that the first teeth are not on the path of the second teeth when the second button is in an operated position thus permitting the first button to be moved from its rest position to an operated position where the first locking member is disengaged from the second locking member, in that the third locking means comprise third teeth coupled to the fourth button and fourth teeth coupled to the third button, in that the fourth teeth are out of engagement with the third teeth when the third and fourth buttons are in a rest position but engage the third teeth when an attempt is made to operate the third button while the fourth button is in a rest position, to block the third button in an intermediate position where the third locking member still engages the fourth locking member while locking the fourth button, and in that the third teeth are not on the path of the fourth teeth when the fourth button is in an operated position thus permitting the third button to be moved from its rest position to an operated position where the third locking member is disengaged from the fourth locking member.

19. Container according to claim 12, characterised in that the second and fourth buttons are one and a same button.

20. Container according to claim 1, characterised by further comprising third locking means for locking the second locking means and a third button operable to act on the third locking means to unlock the second locking means and permit acting on the second locking means by operating the second button.

21. Container according to claim 20, characterised in that the third locking means comprise a third locking member coupled to the second locking means and a fourth locking member coupled to the third button, and in that these third and fourth locking members are engaged with each other when the second and third buttons are in a rest position and may be disengaged from each other by operating the third button.

22. Container according to claim 21, characterised in that the third and fourth locking members each comprise teeth.

23. Container according to claim 20, characterised in that the first and third buttons are provided at side walls of the housing and the second button is provided at a top wall of the housing.

24. Container according to claim 20, characterised in that the first and third buttons are push buttons and the second button is a slide button.

25. Container according to claim 20, characterised in that the first locking means further comprise a fifth locking member coupled to the housing and a sixth locking member coupled to the support and the third button is arranged to also disengage the fifth and sixth locking members when operated.

26. Container according to claim 25, characterised in that the third button is arranged to act on the fifth locking member when operated, to disengage the fifth and sixth locking members.

27. Container according to claim 1, characterised in that said buttons are each subject to the action of elastic return means.

28. Container according to claim 1, characterised in that said buttons are each operable independently of the support.

29. Container according to claim 1, characterised in that said buttons are part of respective distinct pieces that are movable relative to each other.

30. Container according to claim 1, characterised by further comprising a cap coupled to the support and which closes the open end of the housing when the support is in its locked position.

31. Container according to claim 1, characterised in that the support supports at least one blister card containing said medication.

32. Container according to claim 31, characterised in that the blisters of said at least one blister card are fully encased in the housing when the support is in its locked position.

33. Container according to claim 31, characterised in that the support supports several separate blister cards containing said medication and placed side-by-side.

34. Container according to claim 1, characterised in that the medication is in the form of capsules or tablets.

35. Container according to claim 34, characterised in that it contains an even number of tablets.

36. Container according to claim 1, characterised in that it contains 2 to 14 tablets, preferably 6 to 10 tablets, most preferably 10 tablets.

37. Container according to claim 1, characterised in that said medication contains drug for the treatment of cancer, drug having an immediate toxic effect or drug having an effect on the immune system.

38. Container according to claim 37, characterised in that said medication comprises Cladribine or derivatives thereof.

39. Container according to claim 1, characterised in that it has a wallet size.

40. Kit comprising separately a container according to claim 1 and medication.

41. Kit according to claim 40, characterised by further comprising a description containing information on how to handle the container and on the administration and dosing of the medication.

42. Method of opening a container according to claim 19, characterised by comprising the following steps:

holding the housing, operating the second button, operating the first and third buttons while the second button is in its operated position, and pulling the support while the first and third buttons are in their operated position.

43. Method of opening a container according to claim 20, characterised by comprising the following steps:

holding the housing, operating successively the third button, the second button and the first button, and pulling the support while the first and third buttons are in their operated position.

* * * * *

UNITED STATES PATENT AND TRADEMARK OFFICE

CERTIFICATE OF CORRECTION

PATENT NO. : 8,672,134 B2
APPLICATION NO. : 12/936568
DATED : March 18, 2014
INVENTOR(S) : Peter John Sprada et al.

It is certified that error appears in the above-identified patent and that said Letters Patent is hereby corrected as shown below:

In the Claims

In column 13, line 12 claim 1 should read:

--slidably mounted in the housing--

Signed and Sealed this
Twenty-seventh Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,672,134 B2
APPLICATION NO. : 12/936568
DATED : March 18, 2014
INVENTOR(S) : Sprada et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 529 days.

Signed and Sealed this
Twenty-ninth Day of September, 2015

Michelle K. Lee

Michelle K. Lee
*Director of the United States Patent and Trademark Office*